US005478042A

United States Patent [19]

Bliss et al.

[11] Patent Number: 5,478,042

[45] Date of Patent: Dec. 26, 1995

[54] TREE STAND

[76] Inventors: Harold V. Bliss, 3222 E. Dover, Mesa, Ariz. 85213; Harold J. Bliss, Jr., 307 S. York Cir., Mesa, Ariz. 85204

[21] Appl. No.: 281,551

[22] Filed: Jul. 28, 1994

[51] Int. Cl.[6] ..... A47G 33/00

[52] U.S. Cl. ..... 248/523; 248/529

[58] Field of Search ..... 248/523, 529, 248/519, 539, 524, 316.2; 47/40.5

[56] References Cited

U.S. PATENT DOCUMENTS

| | | | |
|---|---|---|---|
| 2,419,183 | 4/1947 | Womack | 248/529 X |
| 2,609,169 | 9/1952 | Kroeger . | |
| 2,671,624 | 3/1954 | Carney . | |
| 3,142,464 | 7/1964 | Zelenitz . | |
| 3,332,649 | 7/1967 | Morrison | 47/40.5 |
| 3,862,733 | 1/1975 | Sullivan . | |
| 4,119,290 | 10/1978 | Gies | 248/523 |
| 4,261,138 | 4/1981 | St. George Syms | 248/523 X |
| 4,601,399 | 7/1986 | Brenteson . | |
| 4,610,356 | 9/1986 | Porter et al. | 248/523 X |
| 4,750,702 | 6/1988 | Neil et al. . | |
| 5,014,461 | 5/1991 | vom Braucke et al. | 248/523 X |
| 5,201,140 | 4/1993 | Voorhis . | |

FOREIGN PATENT DOCUMENTS

| | | | |
|---|---|---|---|
| 2658378 | 6/1978 | Germany | 248/524 |
| 3537362 | 4/1987 | Germany | 248/523 |
| 2208591 | 4/1989 | United Kingdom | 248/523 |

*Primary Examiner*—Karen J. Chotkowski
*Attorney, Agent, or Firm*—Dowell & Dowell

[57] ABSTRACT

A tree stand suitable for supporting a Christmas tree is disclosed. The tree stand includes a base and legs removably secured to the base by interlocking dovetail joints. An elongated rod is disposed on the base for engaging the trunk of a tree. To maintain the engaged tree in a fixed vertical orientation, removable shims are provided to be selectively placed in radially spaced grooves formed in the base, at locations about the exterior of the trunk.

18 Claims, 4 Drawing Sheets

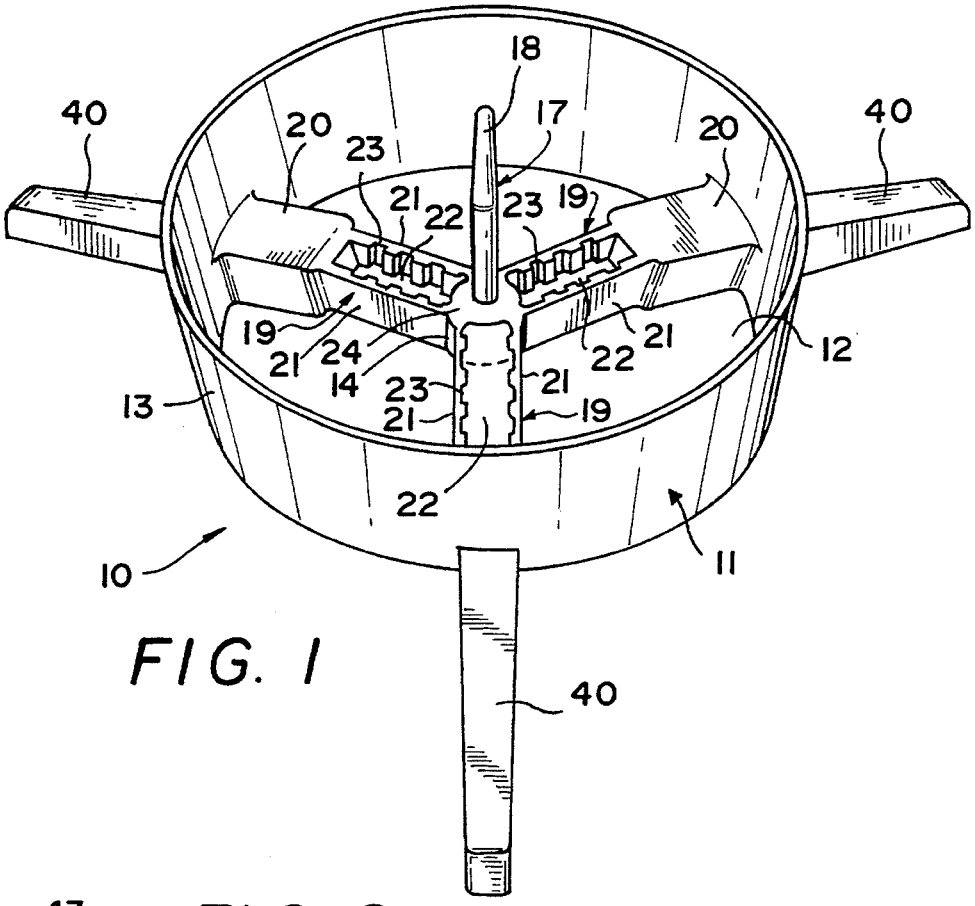
FIG. 1
FIG. 2
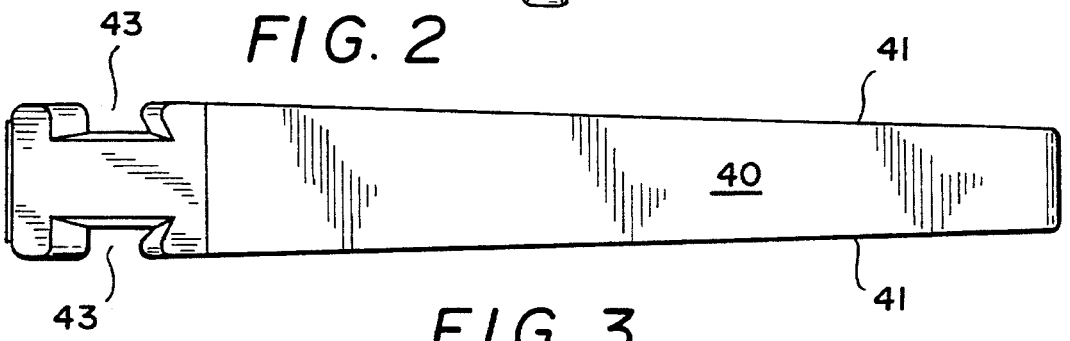
FIG. 3
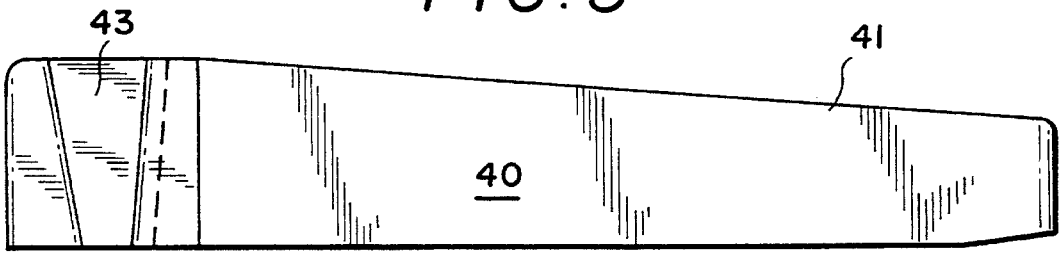

TREE STAND

BACKGROUND OF THE INVENTION

The invention is directed to the field of load bearing stands, and, more particularly, to a stand suitable for supporting a tree.

Tree stands for supporting trees such as Christmas trees and the like have been known for many years. Such stands have often been constructed of metals, and consequently have been relatively heavy and cumbersome. Lighter materials such as plastics have recently been substituted for metals. Although these lighter materials have generally reduced the weight of the stands and their production cost, they have generally also made the tree stands less sturdy.

The known tree stands have also been provided with detachable legs which are removable for storage and shipping purposes. The detachable legs have not proven fully satisfactory, however, due to the poor connections between the legs and the base portion of the tree stand, which have caused the base portion and, thus, the supported tree, to be tilted relative to the supporting surface. To compensate for this problem, users have placed shims about the tree trunk to maintain the tree in a vertical, yet unstable, orientation. But this has been an inadequate solution due to the effort and frustration associated with adjusting the tree, and the unstableness of the tree's adjusted position.

A further disadvantage of the known tree stands has been their limited versatility and adjustability with regard to supporting different tree trunk diameters. Tree stands have been known for supporting fixed sized trunks, such as for artificial trees. Other tree stands; have provided adjustability of the size of the trunk receiving opening. Such stands have included, for example, radially adjustable screws to engage the tree trunk. Such adjusting elements have proven inefficient because more than one person is frequently needed to balance the tree and simultaneously adjust the screws.

SUMMARY OF THE INVENTION

The present invention has been made in view of the above-explained inadequacies of the known tree stands and has as an object to provide a tree stand which is strong, yet lightweight.

Another object of the invention is to provide a tree stand capable of being readily assembled and disassembled for shipping and storage purposes.

A further object of the invention is to provide an adjustable tree stand capable of supporting trees having a wide range of trunk sizes.

Additional objects and advantages of the present invention will become apparent from the description which follows, considered in conjunction with the accompanying drawing figures, or by practice of the invention.

To achieve the objects of the invention, as embodied and broadly described herein, the tree stand in accordance with a preferred embodiment of the invention comprises a base having a bottom wall, an upstanding portion disposed on the bottom wall and defining a bore, and a side wall. The side wall and bottom wall define a plurality of exterior recessed regions, each having a pair of opposed side surfaces. A first dovetail element extends inwardly from each side surface.

The tree stand further comprises an elongated rod which includes a lower portion received in the bore and an upper portion having a pointed upper surface for engaging the tree trunk.

A plurality of legs extend downwardly from the base at an oblique angle. The legs each have a pair of opposed side faces, and a second dovetail element is formed at each side face. The first and second dovetail elements are engageable to form an interlocking joint between the base and legs.

BRIEF DESCRIPTION OF THE DRAWINGS

In the accompanying drawings:

FIG. 1 is an isometric view of a tree stand in accordance with a preferred embodiment of the invention;

FIG. 2 is a top plan view of a leg of the tree stand of FIG. 1;

FIG. 3 is a side elevational view of the leg of FIG. 2;

DETAILED DESCRIPTION OF THE PREFERRED EMBODIMENT

Figure 6:
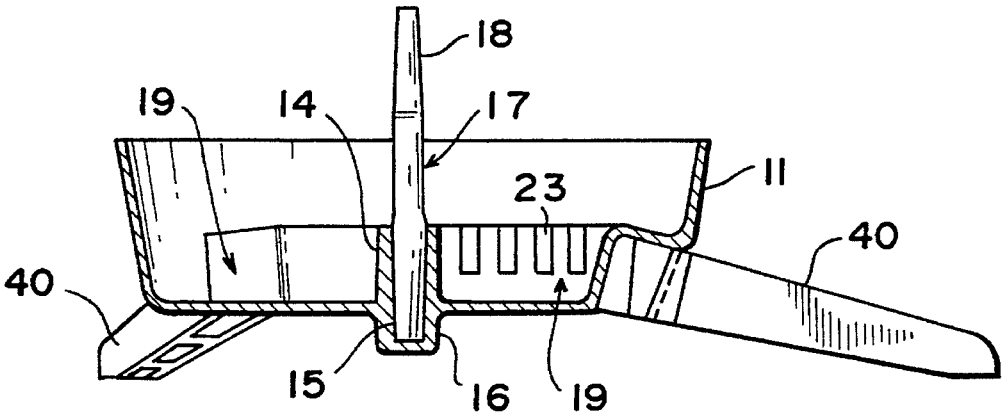
FIG. 6 is cross-sectional view in the direction of line 6—6 of FIG. 5.

FIG. 1 illustrates a tree stand generally 10 in accordance with a preferred embodiment of the invention. The tree stand comprises a base 11 having a circular bottom wall 12 and a cylindrical side wall 13. At a central location of the base, an upstanding portion 14 extends upwardly from the bottom wall 12 and defines a bore 15 as illustrated in FIG. 6. A portion 16 of the base is continuous with the upstanding portion and extends below the bottom wall.

The bore 15 receives an elongated rod 17 which includes a pointed upper portion 18 for inserting in the bottom end of a trunk "T" of a tree (FIG. 7) supported by the tree stand. As illustrated in FIG. 6, the upper portion 18 of the rod extends vertically above the side wall 13 of the base. The rod is preferably composed of a plastic material and may optionally be composed of metal.

Referring to FIG. 1, three reinforcing portions 19 extend radially from the upstanding portion 14 to raised outer portions 20 formed by the bottom wall 12 and side wall 13. The number of reinforcing portions provided corresponds to the number of legs 40 of the tree stand as will be described hereinafter. The reinforcing portions 19 each include opposed side walls 21 which define an intermediate longitudinal channel 22 therebetween. A plurality of vertically extending, interior facing grooves 23 are formed in the side walls 21 along the length of the longitudinal channel. The interior grooves are spaced such that each groove is aligned with a groove in the opposite side wall.

The upper surfaces 24 of the upstanding portion 14 and the reinforcing portions 19 are substantially coplanar and form a horizontal platform for supporting the bottom surface of a tree trunk engaged by the rod 17.

The base 11 is preferably integrally formed of a plastic material.

Figure 7:
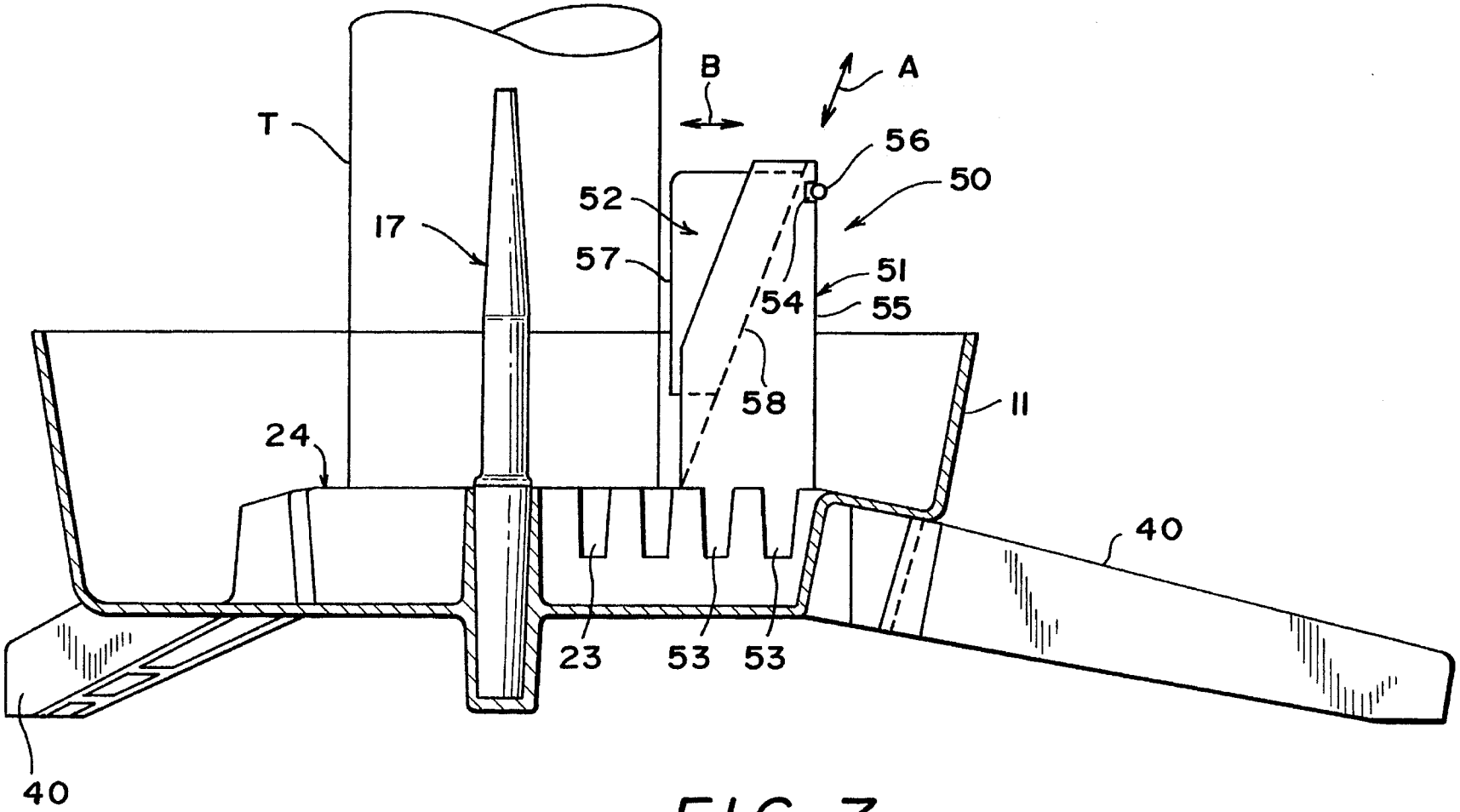
FIG. 7 is an enlarged view similar to FIG. 6 illustrating a shim engaged in the base of the tree stand.

With reference to FIG. 7, the tree stand in accordance with the invention further comprises means for maintaining the tree supported on the platform of the base in a vertical orientation. Shims 50 are preferably provided for this purpose to be selectively inserted in the interior grooves 23 of the reinforcing portions 19.

The shims each comprise two pieces; a mounting piece 51 and a wedge 52, each preferably composed of plastic. The mounting piece includes a pair of legs 53 which are spaced to be received in adjacent pairs of interior grooves 23. The legs have a sufficient width so as to extend across the associated longitudinal channel of the reinforcing portion and be received in the directly opposed interior grooves formed in the opposite sidewall of the reinforcing portion (not shown). The mounting piece may optionally include only a single leg.

A groove 54 is formed on the exterior face 55 of the mounting piece to receive a tie 56 such as a nylon or elastic material. The tie is of a sufficient length to extend around the tree trunk and be inserted in the grooves of the other shims received in the remaining reinforcing portions to hold the shims together and apply pressure on the supported tree (not shown).

The wedge 52 slidably engages the mounting piece 51 and includes an interior face 57 which is proximate to or abuts the tree trunk "T" when the shim 50 is used. By sliding the wedge against the interior face 58 of the mounting piece in the direction of line "A", the radial position of the interior face 57 of the wedge is adjusted in the direction of line "B", depending on the diameter of the tree trunk. For example, for smaller diameter trees, the wedge is moved generally downward such that the interior face 57 moves radially inward toward the tree trunk. In this manner, trees having a range of trunk diameters can be supported by the tree stand.

Figure 4:
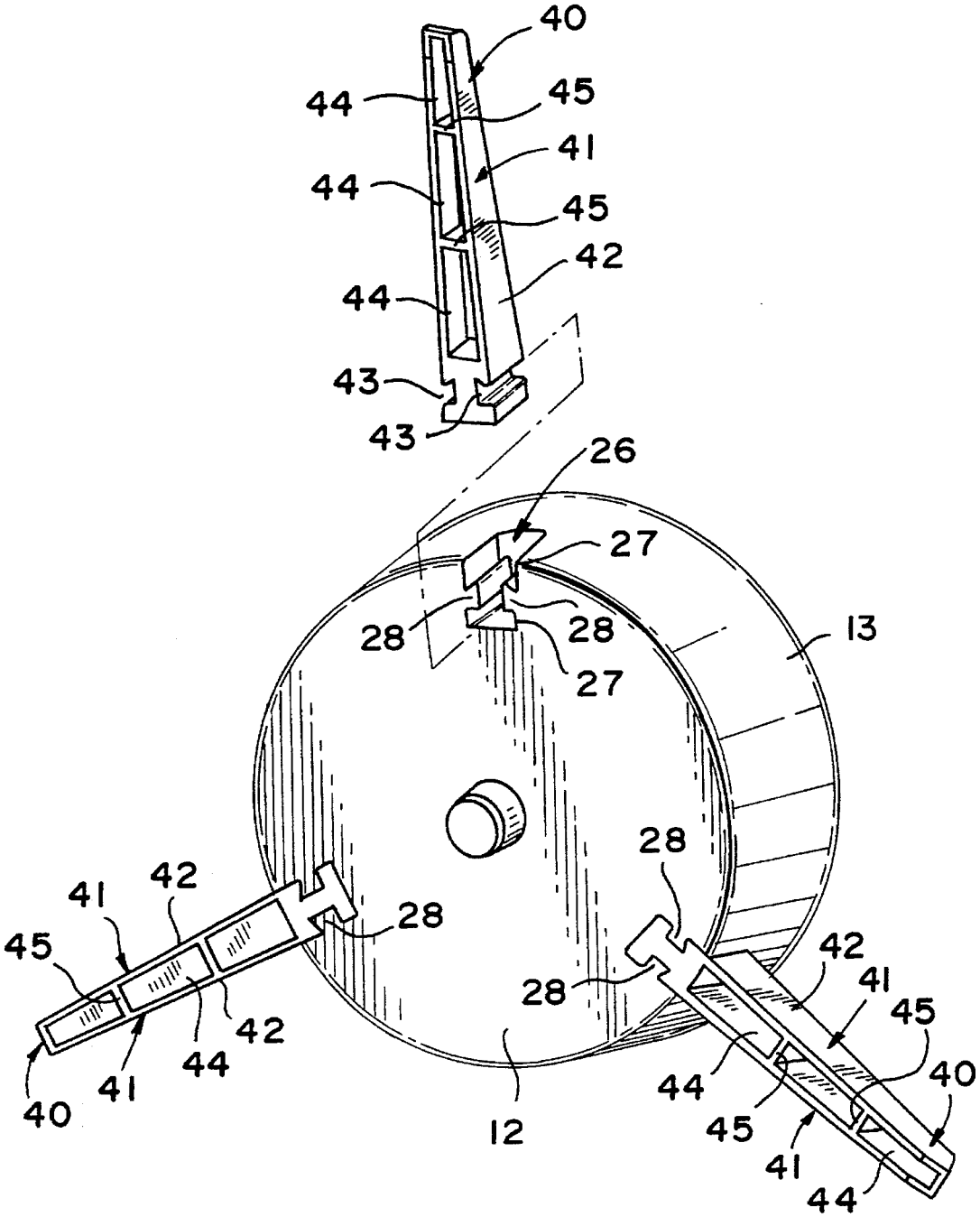
FIG. 4 is a bottom illustrational view of the manner of assembling a leg to the base of the tree stand of FIG. 1.
Figure 5:
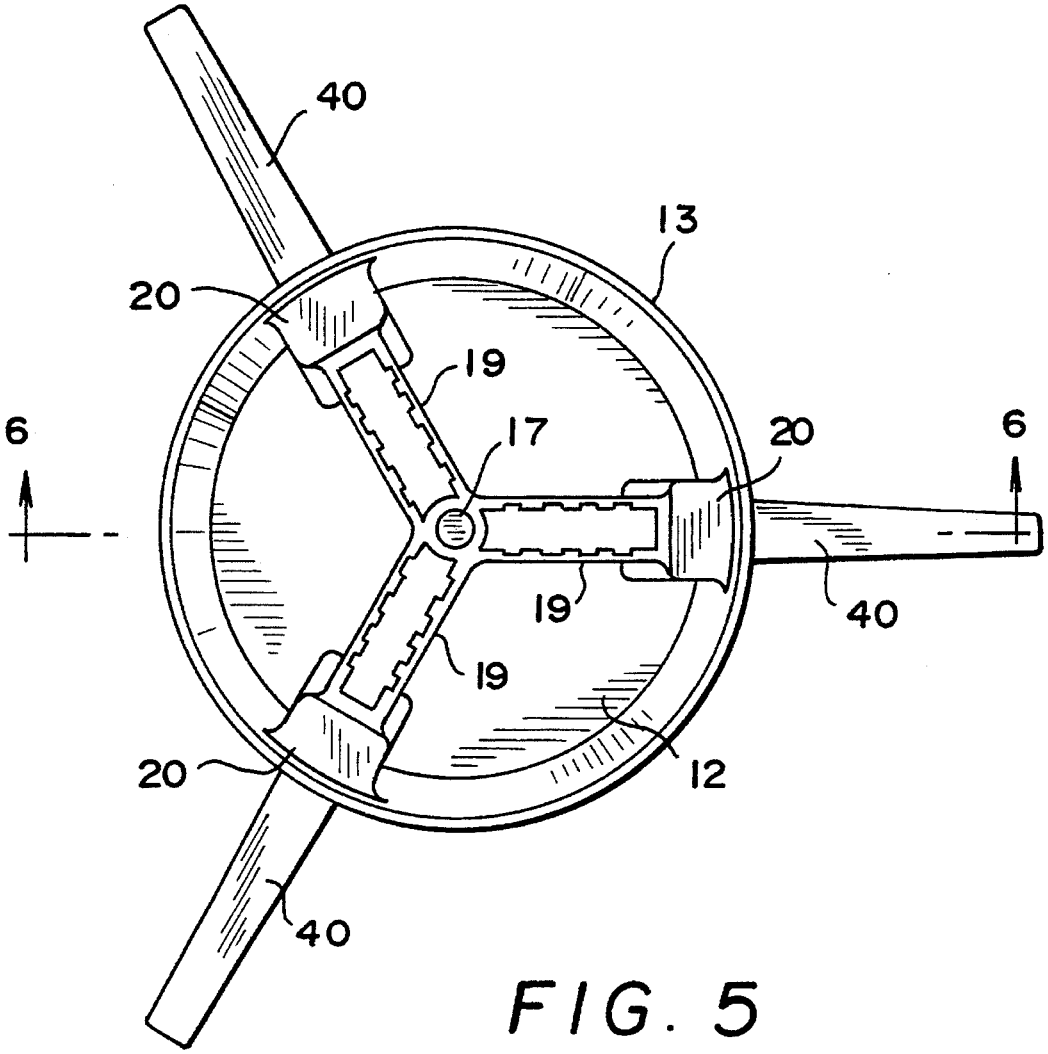
FIG. 5 is a top plan view of the tree stand of FIG. 1.

As illustrated in FIG. 4, the bottom wall 12 and side wall 13 of the base 11 together define exterior recessed regions 26. The recessed regions each include a pair of opposed side walls 27, and first dovetail groove elements 28 extend inwardly from the side walls.

The tree stand preferably comprises three equally circumferentially spaced legs 40 each having a pair of opposed side walls 41 and exterior faces 42. A pair of sunken second mating dovetail elements 43 are provided at each side face for engaging a first dovetail element 28 to form an interlocking dovetail joint between the base and legs. The legs are depicted in further detail in FIGS. 2 and 3.

When the tree stand is assembled as illustrated in FIG. 1, the legs extend downwardly from the base at an oblique angle. An advantage of the dovetail joint is that it is strengthened by increasing the amount of weight supported by the tree stand. As illustrated in FIG. 4, the legs 40 each define a plurality of hollow recessed areas 44 intermediate the side walls 41. The recessed areas are separated from each other by strengthening members 45 connecting the side walls. As also illustrated in FIG. 4, the legs are easily separated from the base by disengaging the dovetail elements. This feature enables the tree stand to be packaged in a compact container for storage or shipping purposes.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. A tree stand comprising:

a base including a bottom wall, an upstanding portion disposed on said bottom wall and defining a bore, a side wall, said side wall and bottom wall defining a plurality of exterior recessed regions, said recessed regions each having a pair of opposed side surfaces, a first dovetail element extending inwardly from each side surface, a plurality of reinforcing portions extending radially from said upstanding portion to said outer wall, adjacent to each recessed region, said reinforcing portions each include opposed side walls forming a longitudinal channel, the opposed side walls each define a plurality of longitudinally spaced and vertically extending interior grooves, and the interior grooves of the opposed side walls being aligned with each other;

an elongated rod having a lower portion received in said bore and an upper portion including a pointed upper surface; and a plurality of legs each extending downwardly from said base at an oblique angle, said legs each having a pair of opposed side faces, a second dovetail element formed at each said side face, said first and second dovetail elements being engageable to form an interlocking joint between said base and said legs.

2. The tree stand of claim 1, wherein said plurality equals three.

3. The tree stand of claim 1, wherein said rod is composed of a plastic material.

4. The tree stand of claim 1, wherein said upstanding portion and said reinforcing portions have a substantially coplanar upper surface forming a platform.

5. The tree stand of claim 4, further comprising means for inserting in selected opposed interior grooves of said reinforcing portions around a trunk of a tree supported by said platform to maintain the tree in a stable vertical orientation.

6. The tree stand of claim 5, wherein the inserting means comprises a plurality of shims, said shims each include a mounting piece and a wedge slidably engaged by said mounting piece, said mounting piece includes a downwardly extending leg which is insertable in an opposed pair of interior grooves, said wedge includes an interior face and the radial position of said interior face is adjustable relative to said elongated rod by sliding said wedge relative to said mounting piece.

7. The tree stand of claim 6, wherein said mounting piece includes a pair of downwardly extending legs which are each insertable in an opposed pair of interior grooves.

8. The tree stand of claim 6, wherein said mounting piece further includes an exterior face and a groove formed therein, and the tree stand further comprises a tie having a sufficient length to be inserted in the groove of each mounting piece so as to hold the mounting pieces together.

9. The tree stand of claim 1, wherein said base is integrally constructed, and said base and said legs are composed of plastic.

10. The tree stand of claim 1, wherein said legs each include a plurality of hollow recessed areas intermediate said side faces, the recessed areas being separated by strengthening members connecting said side faces.

11. The tree stand of claim 1, wherein said upper portion of said rod is vertically disposed above said side wall of said base.

12. A tree stand comprising:

a plastic base including a bottom wall, an upstanding portion extending upwardly from bottom wall and defining a bore, a side wall, said side wall and bottom wall defining three exterior recessed regions, said recessed regions each having a pair of opposed side surfaces, at least one first dovetail element extending inwardly from each side surface, reinforcing portions extending radially from said upstanding portion to said outer wall, adjacent to each recessed region, said reinforcing portions each including opposed side walls forming a longitudinal channel, said side walls defining a plurality of longitudinal spaced and vertically extending interior grooves, the interior grooves of opposed side walls being substantially aligned with each other, said upstanding portion and said reinforcing portions having a substantially coplanar upper surface forming a platform;

an elongated plastic rod having a lower portion received in said bore and an upper portion including a pointed upper surface disposed above said side wall of said base;

means for inserting in selected opposed sunken portions of said reinforcing portions to surround a trunk of a tree engaged by said rod and supported by said platform to maintain the tree in a vertical orientation; and three plastic legs each extending downwardly from said base at an oblique angle, said legs each having a pair of opposed side faces, a second dovetail element formed at each said side face, said first and second dovetail elements being engageable to form an interlocking joint between said base and said legs.

13. A tree stand comprising:

a base including a bottom wall, an upstanding portion extending upwardly from bottom wall and defining a bore, a side wall, a plurality of reinforcing portions extending radially between said upstanding portion and said outer wall, said reinforcing portions each including opposed side walls defining a longitudinal channel, said side walls each having an inner surface defining a plurality of longitudinal spaced and vertically extending interior grooves, the interior grooves of opposed side walls being substantially aligned with each other, said upstanding portion and said reinforcing portions having a substantially coplanar upper surface forming a platform;

an elongated rod having a lower portion received in said bore and an upper portion including a pointed upper surface;

means being insertable in selected interior grooves of said reinforcing portions for surrounding a trunk of a tree engaged by said rod and supported by said platform to maintain the tree in a stable vertical orientation; and a plurality of legs each extending downwardly from said base at an oblique angle, said legs being separable from said base.

14. The tree stand of claim 13, wherein each of said legs is connected to said base by an interlocking dovetail joint.

15. The tree stand of claim 13, wherein said rod, base and legs are composed of plastic, and said base has an integral construction.

16. The tree stand of claim 13, wherein said legs each include a plurality of hollow recessed areas intermediate said side faces, the recessed areas being separated by strengthening members connecting said side faces.

17. The tree stand of claim 13, wherein said upper portion of said rod is disposed above said side wall of said base.

18. The tree stand of claim 13, wherein the inserting means comprises a plurality of shims, said shims each include a mounting piece and a wedge slidably engaged by said mounting piece, said mounting piece includes a pair of downwardly extending legs which are each insertable in an opposed pair of interior grooves, an exterior face having a groove formed therein, said wedge includes an interior face and the radial position of said interior face is adjustable relative to said elongated rod by sliding said wedge relative to said mounting piece, and the tree stand further comprises a tie having a sufficient length to be inserted in the groove of each mounting piece so as to hold the mounting pieces together.

* * * * *